United States Patent [19]

McLaughlin

[11] Patent Number: 4,661,019

[45] Date of Patent: Apr. 28, 1987

[54] WIRE LAYING/BURYING APPARATUS

[76] Inventor: Christopher M. McLaughlin, 4063 A Hancock Ct. Hill AFB, Utah 84056

[21] Appl. No.: 676,049

[22] Filed: Nov. 29, 1984

[51] Int. Cl.[4] ..... E02F 5/10

[52] U.S. Cl. ..... 405/183; 405/174; 405/180; 405/179

[58] Field of Search ..... 405/174, 175, 176, 177, 405/178, 179, 180, 181, 182; 172/611

[56] References Cited

U.S. PATENT DOCUMENTS

| | | | |
|---|---|---|---|
| 2,638,832 | 5/1953 | Kinsinger | 97/47.16 |
| 2,649,746 | 8/1953 | Taylor | 111/5 |
| 2,692,092 | 10/1954 | Kinsinger | 242/85 |
| 2,722,181 | 11/1955 | Hash | 111/5 |
| 2,843,032 | 7/1958 | Jones | 172/611 |
| 3,326,010 | 6/1967 | Gagne | 61/72.6 |
| 3,659,426 | 5/1972 | Caldwell | 61/72.6 |
| 3,905,200 | 9/1974 | Ylinen | 405/175 |
| 4,200,410 | 4/1980 | Baker et al. | 405/181 |
| 4,437,789 | 3/1984 | Kasiewicz | 405/156 |
| 4,447,173 | 5/1984 | Schultz et al. | 405/180 |
| 4,452,550 | 6/1984 | Hofmeester | 405/174 |
| 4,454,921 | 6/1984 | Schlicker, Jr. | 172/699 |
| 4,539,765 | 9/1985 | Reece | 405/179 |

FOREIGN PATENT DOCUMENTS

| | | | |
|---|---|---|---|
| 409691 | 1/1966 | Australia | 405/174 |

*Primary Examiner*—Cornelius J. Husar
*Assistant Examiner*—Hall: Kristina I.
*Attorney, Agent, or Firm*—Jacob N. Erlich; Donald J. Singer

[57] ABSTRACT

An apparatus for laying and burying wire underground having a cutter unit, a tow bar affixed to the front of the cutter unit and a drag plate affixed to the rear of the cutter unit. The cutter unit includes a blade which cuts a slit in the ground into which the wire is layed as the cutter unit is moved over the ground. The drag plate contains a weight and is utilized to repack earth over the slit made by the cutter unit thereby completely burying the wire underground. Motive power for the wire laying/burying apparatus is provided by any suitable vehicle to which the tow bar is attached.

2 Claims, 4 Drawing Figures

WIRE LAYING/BURYING APPARATUS

STATEMENT OF GOVERNMENT INTEREST

The invention described herein may be manufactured and used by or for the Government for governmental purposes without the payment of any royalty thereon.

BACKGROUND OF THE INVENTION

This invention relates generally to an apparatus capable of laying wire, and, more particularly, to an apparatus which is capable of inexpensively laying and burying wire or cable underground.

With the increased use of communication and electrical power transmission systems, the use of wire or cable in order to interconnect a plurality of supply and receiving stations has also drastically increased. For example, in the United States, more than 200,000,000 circuit miles of cable provide the path by which any one of a 120,000,000 telephones can be linked to any other. Although the instrument most commonly connected to a cable is the telephone set; typewriters, television cameras, and other types of data sets all convert information into electrical signals that can be sent over cables or wires.

Although this cable is generally placed aerially or underground in ducts, it may, in many instances, be directly buried in the earth. Such types of buried wire or cable not only find use in military environments, but also in any situation in which it is desirable to interconnect various types of communication or power supply systems where it is impractical to either place these wires aerially or underground in ducts.

Since the waterproofing capability of cables and wires has drastically improved through the years, buried wires have proven to be a practical means of transmitting data. By burying wire or cable undergrond, the chance of such wires being disturbed or disrupted by external means is substantially reduced. For example, buried wires are incapable of being run over by vehicles passing thereover or being broken or ripped during violent weather conditions. Furthermore, during military use the burying of wire prevents such wire or cable from being viewed by the enemy.

Unfortunately, heretofore, the laying and burying of wire and cable has been done either by manually in a very tedious and time consuming procedure, or by the utilization of self-propelled vehicles which not only plow the earth but implant the wire or cables therebeneath. Such vehicles, however, are extremely expensive and, in most instances, make the entire cost of laying wire underground prohibitive. It would therefore be extremely desirous if an apparatus could be developed which would make the laying and burying of wire or cable extremely simple, reliable and cost efficient.

SUMMARY OF THE INVENTION

The present invention overcomes the problems encountered in the past and as set forth in detail hereinabove by providing an apparatus capable of laying and burying wire or cable underground in a very efficient yet cost effective manner.

The wire laying apparatus of the present invention is in the form of a cutter unit adapted to be towed behind any type of vehicle such as a flat bed truck and which is capable of receiving either from the vehicle or other source a wire or cable to be layed and buried underground.

The cutter unit of the wire laying apparatus of the present invention includes a pair of mounts having the bottom of each in the form of a ski-like runner. Sandwiched between the mounts is a thin blade which extends a preselected distance to beneath the bottom of the mounts, preferably 10–14 inches. The ski-like runners are utilized to guide the apparatus along the surface of the ground during the wire laying operation.

The blade utilized with the present invention is thin and attaches at one end thereof between the pair of mounts in order to cut a trench or slit in the earth as the cutter unit is pulled along by means of the external motive power. It is essential that the blade merely cut an opening within the earth's surface and not push the earth aside since as the cutter unit continues along its path, the disrupted earth can fall back in place over the buried wire.

The blade utilized with the present invention is preferably made of a steel plate and may in some instances be equivalent to a scarifier, that is, a type of tooth utilized and attached to road graders. Generally this blade is no more than one inch thick and is not sharpened. The wire to be layed and buried comes off a large reel which is located either on the vehicle which pulls the wire laying apparatus of this invention or, in some instances, is incorporated as part of the wire laying apparatus itself.

The wire is fed to the cutter unit by means of a specially configured tubular arrangement or conduit which circumscribes the top and side portions of the blade. The wire is received in one end of the conduit and exits from the other end thereof in back of yet adjacent to the bottom edge of the blade. In this manner the wire or cable may reach its maximum depth within the trench or slit formed by the blade without interfering with the cutting action of the blade.

Pivotally secured to the front of the cutter unit is a tow bar. The tow bar is generally conventional in design, having an "eye" at the forward end thereof that is capable of fitting any universal mount on the driving vehicle. In addition, included as part of the tow bar is a guiding element approximately midway between the ends of the tow bar to guide the wire into the conduit prior its entrance into the earth. This guide also is configured so as to help untangle any snags which may be formed in the wire during its unravelling from the wire reel.

Secured to the other end of the mount and towed behind the cutter unit as it proceeds in its wire laying operation is a drag plate or container-like configured structure which is filled with a weight. As it is towed along by the cutter unit, the drag plate pushes the earth back over the slit. This procedure actually flattens and spreads the earth back over the wire in the slit as the cutter unit moves forward. Additional weight can be added to the cutter unit by placing such weight on the ski-like runners formed as part of the mount of the cutter unit. The drag plate is attached to the cutter unit by means of a pair of bars pivotally connected thereto, so that when the wire laying apparatus is in its nonoperational state the drag plate can be folded toward the cutter unit and render the apparatus extremely compact.

During operation, the wire laying apparatus is pulled along by a vehicle. As the wire laying apparatus is dragged behind the vehicle, the wire is continually drawn from its reel and directed into the slit formed in the earth by the blade of the cutter unit. Substantially coincidently with the laying of the wire, the drag plate smoothes over the roughened earth so as to pack the earth back in place over the wire or cable thereby completely hiding the wire from sight.

It is therefore an object of this invention to provide an apparatus capable of not only laying wire or cable, but also burying wire beneath the earth's surface in an extremely efficient manner.

It is another object of this invention to provide a wire laying and burying apparatus which can be attached to any type of driving vehicle.

It is still another object of this invention to provide a wire laying and burying apparatus which is economical to produce and which utilizes conventional, currently available components that lend themselves to standard mass producing manufacturing techniques.

For a better understanding of the present invention, together with other and further objects thereof, reference is made to the following description, taken in conjunction with the accompanying drawings and its scope will be pointed out in the appended claims.

DETAILED DESCRIPTION OF THE PREFERRED EMBODIMENT

Figure 1:
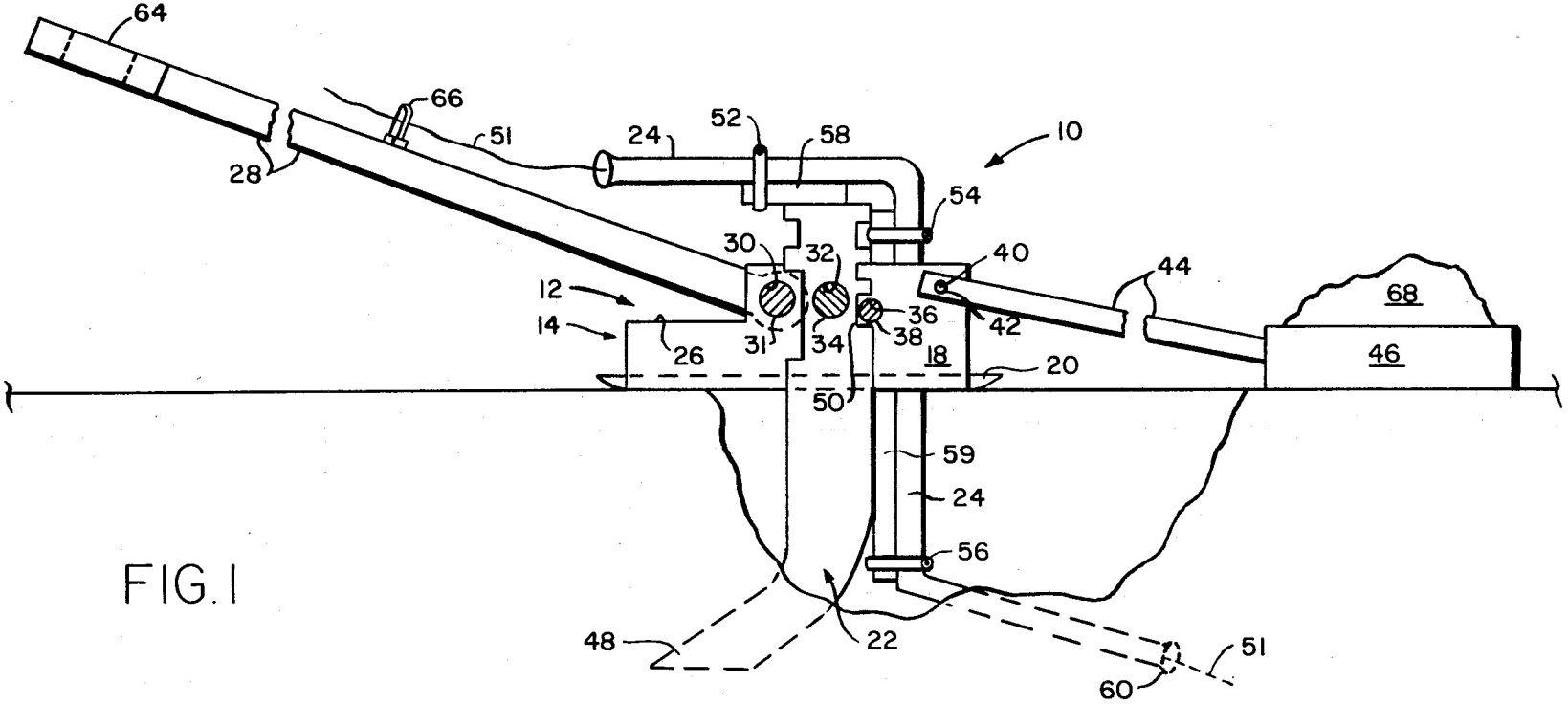
FIG. 1 is a side elevational view of the wire laying/-burying apparatus of this invention shown partly in cross-section.
Figure 2:
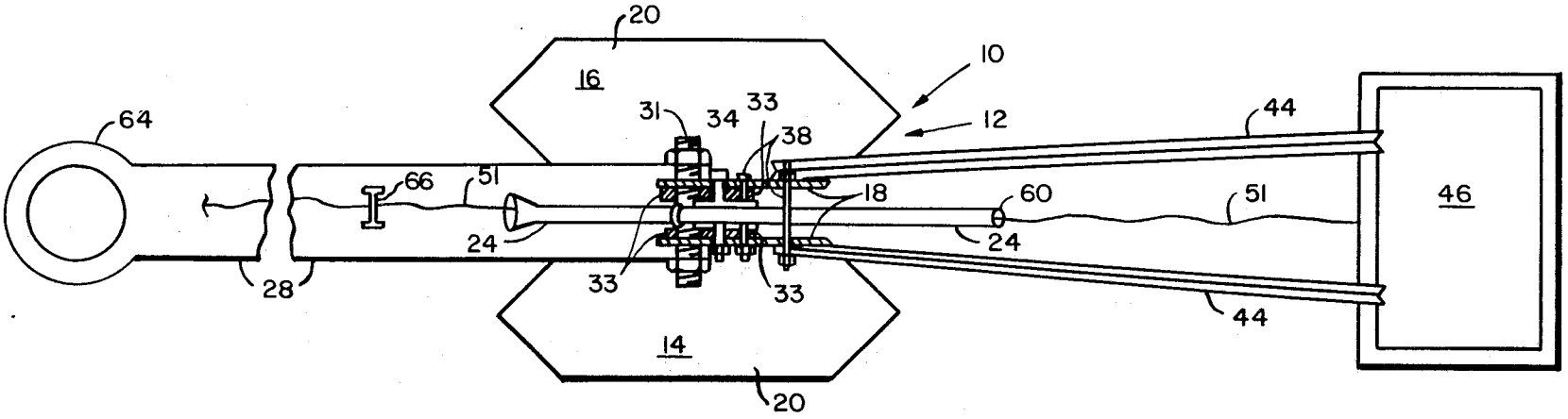
FIG. 2 is a plan view of the wire laying/burying apparatus of this invention shown partly in cross section.

Reference is now made to FIGS. 1 and 2 of the drawings which clearly depict the wire laying apparatus 10 of the present invention. Apparatus 10 is made up of a cutter unit 12 which is capable of being affixed to any conventional type of vehicle 13 (depicted in FIGS. 3 and 4 of the drawings) such as a flat bed truck or jeep. Vehicle 13 provides the mode of power for pulling the wire laying apparatus 10 of the present invention along the ground during the wire laying operation.

More specifically, cutter unit 12 includes a pair of mounts 14 and 16. Each of the mounts 14 and 16 are formed of an angled plate having an upstanding element 18 and a portion extending perpendicular thereto in the form of a ski-like runner 20. This ski-like runners 20 are utilized to aid in the transporting of the cutter unit 12 over the surface of the earth. In addition, if extra weight is to be added to the wire laying/burying apparatus 10 it can be placed on the runners 20. Completing the make up of cutter unit 12 are the blade 22 and wire guiding conduit 24, both of which will be described in greater detail hereinbelow.

The forward end of mounts 14 and 16 of cutter unit 12 are cut out at 26 in order to enable a tow bar 28 to be freely movable when pivotally secured to mounts 14 and 16. More specifically, each of the upstanding elements 18 of mounts 14 and 16, respectively, have three holes drilled therein. The first hole of each of the mounts 14 and 16 is a $\frac{3}{4}$ inch hole 30 placed approximately 1 inch from the cutout section 26. Hole 30 is utilized in order to pivotally secure tow bar 28 between the upstanding elements 18 of mounts 14 and 16. A bolt 31 is inserted within holes 30 for pivotally securing tow bar 28 in place.

The next hole 32 is approximately $\frac{5}{8}$ inch in diameter and is used to mount blade 22 between the two upstanding elements 18. A bolt 34 is used to secure the blade 22 in place. In order to prevent the relative movement between the blade 22 and mounts 14 and 16 from taking place, a plurality of spacers or washers 33 (shown in FIG. 2) may be interposed between elements 18.

The third hole 36 is approximately $\frac{3}{8}$ inches in diameter and is rearward of the second hole 32 approximately one-half inch below the second hole 32. It has positioned therein a bolt 38 which is utilized to maintain blade 22 in its proper angle with respect to the ground.

The last hole 40 is placed approximately 1 inch from the rear of mounts 14 and 16. It is through holes 40 that a bolt 42 is inserted which pivotally secures a pair of bars 44 in place. Bars 44 have a drag plate 46 secured thereto. It is critical that the bars 44 of the drag plate 46 be on the outside of upstanding elements 18 of mounts 14 and 16 so that this drag plate 46 can be folded in place during the non-operational use of wire laying apparatus 10.

The above dimensions are given merely to present an approximation of the relative positioning of the various components of the wire laying apparatus 10 of the present invention. These dimensions, however, may be varied depending upon the actual configuration and size of the wire laying/burying apparatus 10 of the present invention.

Referring now specifically to the cutter unit 12 of the wire laying/burying apparatus 10, the blade 22 is made of relatively thin hardened steel, preferably one inch in thickness, being straight-sided and having an angled cutting edge 48. The blade 22 is unsharpened and may be in the form of a scarifier, that is, a type of tooth that is attached to road graders. The blade has a centered hole drilled substantially near the top thereof through which bolt 34 passes in order to secure blade 22 between mounts 14 and 16. In addition, blade 22 has a cut out 50 formed adjacent the rear upper edge which aligns with bolt 38 in order to hold blade 22 at its proper angle with respect to the ground.

Continuing with the description of the cutter unit 12 of the wire laying/burying apparatus 10 of this invention, the wire or cable 51 to be buried beneath the surface of the earth is directed to its appropriate position adjacent and behind blade 22 by means of a wire guiding conduit 24 which is configured in the shape of a Z. The wire guiding conduit 24 is affixed by any suitable clamps 52, 54 and 56 to a pair of support rods 58 and 59 which are fixedly secured by welding, for example, to the top and side of blade 22, respectively. It is critical that conduit 24 be adjusted and positioned so that its exit opening 60 be substantially in line with the bottom of blade 22 as illustrated in FIG. 1 of the drawings. Such an arrangement enables the wire 51 to be layed at substantially the same depth as the bottom of blade 22.

As stated above tow bar 28 extends from the forward end of mount 12 and is secured in position by a bolt 31 which passes through holes 30 in upstanding elements 18. The tow bar 28 has an "eye" 64 configured at the forward end thereof for securement to the hitch of any conventional driving vehicle 13. In addition, a guide 66 is secured midway between the ends of tow bar 28 in order to guide the wire therethrough and remove any snags from the wire 51 prior to its insertion into conduit 24 and before being introduced beneath the surface of the earth.

Also as pointed out above, pivotally secured to the further portion of the mounts 14 and 16 of cutter unit 12 by means of bolt 42 are a pair of pivotally mounted bars 44 which have affixed at the end thereof a drag plate 46 capable of being filled with a weight or sandbags 68. Drag plate 46 is utilized in packing the earth on top of the slit made by blade 22 after the wire 51 has been layed therein. As shown in FIGS. 1 and 2 of the drawings bars 44 are of sufficient length so that the drag plate 46 is positioned in back of rear portion of the exit 60 of conduit 24. This arrangement specific enables the wire to be layed in place prior to the repacking of the earth.

Figure 3:
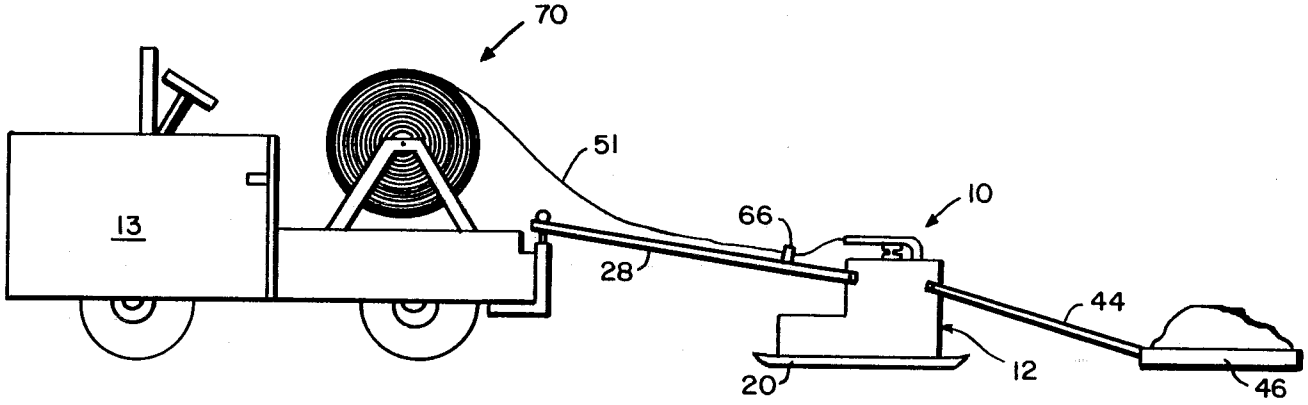
FIG. 3 is a pictorial representation of the wire laying/burying apparatus of this invention utilized in conjunction with a driving vehicle in which the reel for the wire is contained in the vehicle.
Figure 4:
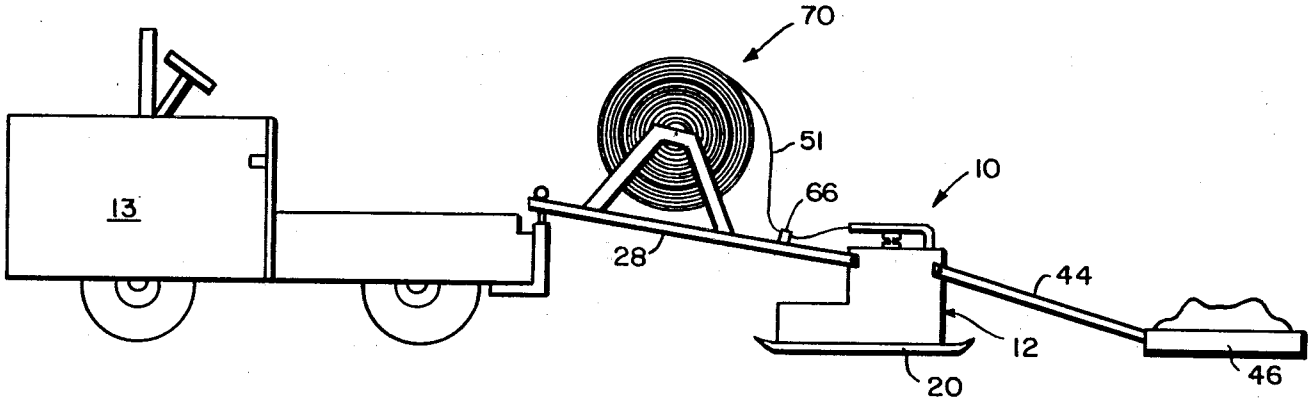
FIG. 4 is a pictorial representation of the wire laying/burying apparatus of this invention shown in conjunction with a driving vehicle and in which the reel for the wire is formed as part of the wire laying apparatus.

As shown in FIG. 3 of the drawings of the reel 70 from which the wire 51 is distributed prior to being layed and buried by the wire laying apparatus 10 of the present invention may be contained on the vehicle 13 utilized for towing apparatus 10. Under certain circumstances, as shown in FIG. 4 of the drawings, the wire reel 70 may be interconnected with tow bar 28 so that the wire laying apparatus of the present invention becomes a more self-contained apparatus.

MODE OF OPERATION

In operation, when it becomes desirable to lay and bury wire 51 under the ground, one merely has to attach the wire laying/burying apparatus of the invention to any type of vehicle 13 such as a jeep or flat bed truck from which the wire 51 may be dispensed as shown in FIG. 3. As pointed out above it is also possible to dispesnse the wire directly from the wire laying apparatus 10 and in such case the reel 70 is formed as part of the tow bar 28 depicted in FIG. 4.

Prior to commencement of the wire laying operation wire 51 is fed from reel 70 through guide 66 on tow bar 28 and into wire guiding conduit 24. From the exit 60 of conduit 24 wire 51 is affixed to a power source or communications station from which the wire is to be interconnected. Once an initial trench has been dug so as to start the wire in its underground position, one has merely to drive the vehicle 13 thereby towing the wire laying/burying apparatus 10 over the ground. The ski-like runners permit the cutter unit to slide with reduced fricion over the ground.

In so doing apparatus 10 cuts a slit in the earth's surface with the wire being layed and buried within the slit. Upon continual movement of the wire laying/burying apparatus 10 along the earth's surface, the slit is continually cut in the earth with the drag plate being uitlized to reimpact or recover the earth over the slit formed in the earth. With the wire laying/burying apparatus 10 of the present invention such a wire laying and burying operation becomes extremely simple and inexpensive to perform.

Although this invention has been described with reference to a particular embodiment, it will be understood that this invention is also capable of further and other embodiments within the spirit and scope of the appended claims.

I claim:

1. A wire laying/burying apparatus, comprising:

a cutter unit, said cutter unit including:

means for guiding said unit across the ground, said guiding means including a pair of elements, each of said elements having a ski-like flat surfaced runner substantially parallel to said ground attached thereto; means interconnected with said guiding means for cutting a slit in said ground as said unit moves across said ground, said cutting means being interposed between said pair of elements of said guiding means and including a straight sided, unsharpened blade, said blade extending a predetermined distance beneath said guiding means; and means in the form of a conduit secured to and surrounding the upper portion of said cutting means for receiving said wire from a wire reel and directing said wire around said cutting means into said slit in said ground as said cutter unit moves over said ground;

means pivotally secured to one end of said cutter unit for interconnecting said cutter unit to a vehicle for pulling said cutter unit across said ground, said cutter unit interconnecting means including a tow bar pivotally connected to one end thereof to said guiding means, and means connected to said tow bar for receiving and unravelling any snags in said wire prior to said wire being received by said wire receiving and directing means; and means pivotally secured to the other end of said cutter unit for packing earth displaced by said cutting means back over said slit after said wire has been layed in said slit, said earth packing means including means for containing a weighted substance therein and means for interconnecting said containing means to said guiding means.

2. A wire laying/burying apparatus as defined in claim 1 wherein said wire reel is positioned on said tow bar.

* * * * *